US007739105B2

(12) United States Patent
Zeng

(10) Patent No.: US 7,739,105 B2
(45) Date of Patent: Jun. 15, 2010

(54) SYSTEM AND METHOD FOR PROCESSING AUDIO FRAMES

(75) Inventor: Hong Zeng, North York (CA)

(73) Assignee: VIXS Systems, Inc., Toronto, Ontario (CA)

( * ) Notice: Subject to any disclaimer, the term of this patent is extended or adjusted under 35 U.S.C. 154(b) by 1641 days.

(21) Appl. No.: 10/461,095

(22) Filed: Jun. 13, 2003

(65) Prior Publication Data

US 2004/0254785 A1 Dec. 16, 2004

(51) Int. Cl.
*G10L 11/00* (2006.01)
*G10L 21/02* (2006.01)
*G10L 19/00* (2006.01)

(52) U.S. Cl. ..... 704/200.1; 704/200; 704/500; 704/226

(58) Field of Classification Search ..... 704/200.1, 704/229, 228, 226, 200, 500
See application file for complete search history.

(56) References Cited

U.S. PATENT DOCUMENTS 4,866,395 A 9/1989 Hosteller
5,027,203 A 6/1991 Samad et al.
5,093,847 A 3/1992 Cheng
5,115,812 A 5/1992 Sano et al.
5,253,056 A 10/1993 Puri
5,475,434 A 12/1995 Kim
5,481,614 A * 1/1996 Johnston ..... 381/2
5,563,950 A 10/1996 Easter et al.
5,602,589 A 2/1997 Vishwanath et al.
5,635,985 A 6/1997 Boyce et al.
5,644,361 A 7/1997 Ran et al.
5,652,749 A 7/1997 Davenport et al.
5,732,391 A * 3/1998 Fiocca ..... 704/229
5,737,020 A 4/1998 Hall et al.
5,737,721 A * 4/1998 Kwon ..... 704/229
5,740,028 A 4/1998 Sugiyama et al.
5,764,698 A * 6/1998 Sudharsanan et al. ..... 375/241
5,844,545 A 12/1998 Suzuki et al.
5,850,443 A 12/1998 Van Oorschot et al.
5,940,130 A 8/1999 Nilsson et al.
5,996,029 A 11/1999 Sugiyama et al.
6,005,623 A 12/1999 Takahashi et al.
6,005,624 A 12/1999 Vainsencher
6,014,694 A 1/2000 Aharoni et al.
6,040,863 A 3/2000 Kato
6,081,295 A 6/2000 Adolph et al.
6,141,693 A 10/2000 Perlman et al.

(Continued)

FOREIGN PATENT DOCUMENTS

EP 0661826 A2 7/1995

(Continued)

OTHER PUBLICATIONS

Brandenburg, K., "MP3 and AAC Explained," Proceedings of the International AES Conference, pp. 99-110, XP008004053.

(Continued)

*Primary Examiner*—Richemond Dorvil
*Assistant Examiner*—Douglas C Godbold

(57) ABSTRACT

In accordance with a specific implementation of the disclosure, a stream of audio frames is received and compressed using psycho-acoustical processing. The signal-to-mask ratio table generated by the psycho-acoustical algorithm is updated using only a portion of the received audio frames.

15 Claims, 5 Drawing Sheets

U.S. PATENT DOCUMENTS

| | | | | |
|---|---|---|---|---|
| 6,144,402 | A | 11/2000 | Norsworthy et al. | |
| 6,167,084 | A | 12/2000 | Wang et al. | |
| 6,182,203 | B1 | 1/2001 | Simar, Jr. et al. | |
| 6,215,821 | B1 | 4/2001 | Chen | |
| 6,219,358 | B1 | 4/2001 | Pinder et al. | |
| 6,222,886 | B1 | 4/2001 | Yogeshwar | |
| 6,236,683 | B1 | 5/2001 | Mougeat et al. | |
| 6,259,741 | B1 | 7/2001 | Chen et al. | |
| 6,263,022 | B1 | 7/2001 | Chen et al. | |
| 6,300,973 | B1 | 10/2001 | Feder et al. | |
| 6,307,939 | B1 | 10/2001 | Vigarie | |
| 6,308,150 | B1 * | 10/2001 | Neo et al. | 704/200.1 |
| 6,314,138 | B1 | 11/2001 | Lemaguet | |
| 6,323,904 | B1 | 11/2001 | Knee | |
| 6,366,614 | B1 | 4/2002 | Pian et al. | |
| 6,385,248 | B1 | 5/2002 | Pearlstein et al. | |
| 6,438,168 | B2 | 8/2002 | Arye | |
| 6,480,541 | B1 | 11/2002 | Girod et al. | |
| 6,487,535 | B1 * | 11/2002 | Smyth et al. | 704/500 |
| 6,526,099 | B1 | 2/2003 | Christopoulos et al. | |
| 6,549,561 | B2 | 4/2003 | Crawford | |
| 6,584,509 | B2 | 6/2003 | Putzolu | |
| 6,714,202 | B2 | 3/2004 | Dorrell | |
| 6,724,726 | B1 | 4/2004 | Coudreuse | |
| 6,748,020 | B1 | 6/2004 | Eifrig et al. | |
| 6,813,600 | B1 * | 11/2004 | Casey et al. | 704/200.1 |
| 6,937,988 | B1 * | 8/2005 | Hemkumar et al. | 704/500 |
| 2001/0026591 | A1 | 10/2001 | Keren et al. | |
| 2002/0106022 | A1 | 8/2002 | Takahashi et al. | |
| 2002/0110193 | A1 | 8/2002 | Yoo et al. | |
| 2002/0118756 | A1 * | 8/2002 | Nakamura et al. | 375/240.17 |
| 2002/0138259 | A1 | 9/2002 | Kawahara | |
| 2002/0145931 | A1 | 10/2002 | Pitts | |
| 2002/0196851 | A1 | 12/2002 | Lecoutre | |
| 2003/0093661 | A1 | 5/2003 | Loh et al. | |
| 2003/0152148 | A1 | 8/2003 | Laksono | |

FOREIGN PATENT DOCUMENTS

| | | | |
|---|---|---|---|
| EP | 0739138 | A2 | 10/1996 |
| EP | 0805599 | A2 | 11/1997 |
| EP | 0855805 | A2 | 7/1998 |
| EP | 0896300 | B1 | 2/1999 |
| EP | 0901285 | A1 | 2/1999 |
| EP | 0955607 | A2 | 11/1999 |
| EP | 1032214 | A2 | 8/2000 |
| EP | 1087625 | A2 | 3/2001 |
| JP | 07-210670 | A | 8/1995 |
| WO | WO 01/95633 | A2 | 12/2001 |
| WO | WO 02/080518 | A2 | 10/2002 |

OTHER PUBLICATIONS

Painter, T., "Perceptual coding of Digital Audio," Proceedings of the IEEE, IEEE, New York, vol. 88, No. 4, pp. 41-513, XP001143231, ISSN: 0018-9219.

Yu, Donghoom, et al., "Fast Motion Estimation for Shape Coding in MPEG-4," IEEE Transactions on Circuits and Systems for Video Technology, vol. 13, No. 4, 2003 IEEE, Apr. 2003, pp. 358-363.

Pyun, Jae-Young, "QoS Provisioning for Video Streaming Over IEEE 802.11 Wireless LAN," (abridged) IEEE Conferences in Consumer Electronics, Jun. 16, 2003, EE Times, Seoul, Korea, <http://eetimes.com/printableArticle?doc_id=OEG2003061S0070> retrieved Jul. 8, 2003.

Youn, Jeongnam et al., "Video Transcoding for Multiple Clients," Proceedings of the SPIE, Bellingham, VA, vol. 4067, XP008012075, pp. 76-85, University of Washington, Sealttle, WA, 2000.

Lengwehasatit, Krisda et al.. "Computationally Scalable Partial Distance Based Fast Search Motion Estimation," Packet Video Corp., San Diego, California, 1999.

Takahashi, Kuniaki, et al., "Motion Vector Synthesis Algorithm for MPEG2-to-MPEG4 Transcoder," Proceedings of the SPIE, Bellingham, VA, vol. 4310, Sony Corporation, XP008000078, pp. 387-882, 2001 SPIE.

Soares, Luis Ducla, et al., "Influence of Encoder Parameters on the Decoded Video Quality for MPEG-4 Over W-CDMA Mobile Networks." NTT DoCoMo, Inc., 2000.

Aggarwal, Manoj et al., "Efficient Huffman Decoding," 2000 IEEE, 0-7803-6297-7, pp. 936-939, University of Illinois at Urbana-Champaign, Urbana, IL.

Sherwood, P. Greg et al., "Efficient Image and Channel Coding for Wireless Packet Networks," University of California, La Jolla, California, 2000.

Assuncao, Pedro et al., "Rate Reduction Techniques for MPEG-2 Video Bit Streams," SPIE, vol. 2952, Apr. 1996, pp. 450-459, University of Essex, Colchester, England.

Yin, Peng et al., "Video Transcoding by Reducing Spatial Resolution." Princeton University, 2000, Princeton, New Jersey.

Shanableh, Tamer et al., "Heterogeneous Video Transcoding to Lower Spatio-Temporal Resolutions and Difference Encoding Formats," IEEE Transactions on Multimedia, vol. 2, No. 2, Jun. 2000, pp. 101-110, Engineering and Physical Sciences Researc Counsel, Colchester, U.K.

Wiegand, Thomas et al., "Long-Term Memory Motion-Compensated Prediction for Rubust Video Transmittion," in Proc. ICIP 2000, University of Erlangen-Buremberg, Erlangen, Germany.

Fan, Zhigang et al. "Maximum Likelihood Estimation of JPEG Quantization Table in the Identification of Bitmap Compression History," Xerox Corporation, Webster, New York, 2000.

Thomas, Shine M. et al., "An Efficient Implentation of MPEG-2 (BC1) Layer 1 & Layer 2 Stereo Encoder on Pentium-III Platform", pp. 1-10, Sasken Communication Technologies Limited, Bangalore. India, 2000.

Ramanujan, Ranga S. et al., "Adaptive Streaming of MPEG Video Over IP Networks," 22nd IEEE Conference on Local Computer Networks (LCN '97), Nov. 2-5, 1997, 1997 IEEE, pp. 398-409, Architecture Technology Corporation, Minneapolis, MN.

Rejaie, Reza et al., "Architectural Considerations for Playback of Quality Adaptive Video Over the Internet," XP002177090, 2000 IEEE pp. 204-209, AT&T Labs, Menlo Park, California.

Bouras, C. et al.,"On-Demand Hypermedia/Multimedia Service Over Broadband Networks," XP-002180545, 1996 IEEE Proceedings of HPDC-5 '96, pp. 224-230, University of Patras, Patras, Greece.

Chalidabhongse, Junavit et al., "Fast Motion Vector Estimation Using Multiresolution-Spatio-Temporal Correlations," IEEE Transactions on Circuits and Systems for Video Technology, vol. 7, No. 3 Jun. 1997, pp. 477-488.

Oh, Hwang-Seok et al., "Block-Matching Algorithm Based on an Adaptive Reduction of the Search Area for Motion Estimation." Real-Time Imaging, Academic Press Ltd., vol. 56, No. 5, Oct. 2000, pp. 407-414, XP004419498 ISSN: 1077-2014 , Taejon, Korea.

Lee, Liang-Wei et al., "Dynamic Search-Window Adjustment and Interlaced Search for Block-Matching Algorithm," IEEE Transactions on Circuits and Systems for Video Technology, IEEE, vol. 3, No. 1, Feb. 3, 1993, pp. 85-87, XP000334581 ISSN: 1051-8215, New York.

Fukunaga, Shigeru et al., "MPEG-4 Video Verification Model Version 16.0" International Organization for Standardization: Coding of Moving Pictures and Audio, vol. N3312, Mar. 2000, pp. 1-380, XP000861688.

Kroner, Sabine et al., "Edge Preserving Noise Smoothing With an Optimized Cubic Filter," DEEI, University of Trieste, Trieste, Italy, 1998.

Kim, Jaemin et al., "Spatiotemporal Adaptive 3-D Kalman Filter for Video," pp. 1-12: Samsung Semiconductor, Inc. San Jose, Calfiornia, 1997.

Liu, Julia J., "ECE497KJ Course Project: Applications of Wiener Filtering in Image and Video De-Noising," pp. 1-15, May 21, 1997.

Jostschulte, K. et al., "A Subband Based Spatio-Temporal Noise Reduction Technique for Interlaced Video Signals," University Dortmund, Dortmund, Germany, 1998.

Kossentini, Faouzi et al. "Predictive RD Optimized Motion Estimation for Very Low Bit-Rate Video Coding," 1997 IEEE, XP-000726013, pp. 1752-1963, Sep. 1, 1996, 1997 International Conference on Image Processing, Vancouver, Canada.

Tourapis, Alexis et al. "New Results on Zonal Based Motion Estimation Algorithms—Advanced Predictive Diamond Zonal Search," 2001 IEEE, pp. V 183-V 186, The Hong Kong University of Science and Technology, Clear Water Bay, Kowloon, Hong Kong.

Brandenburg, Karlheinz, "MP3 and AAC Explained," Proceedings of AES 17th International Conference, XP008004053, pp. 99-110, Erlangen, Germany, 2000.

Painter, Ted et al., "Perceptual Coding of Digital Audio," Proceedings of the IEEE, vol. 88, No. 4, Apr. 2000, pp. 451-513, XP001143231, ISSN: 0018-9219, Arizona State University, Tempe. AZ.

Hassanzadegan, Hooman et al., "A New Method for Clock Recovery in MPEG Decoders," pp. 1-8, Basamad Negar Company, Tehran, Iran, 2000.

Kan, Kou-Sou et al., "Low-Complexity and Low-Delay Video Transcoding for Compressed MPEG-2 Bitstream," Natinal Central University, Chung-Li, Taiwan, 2003.

Mitchell et al., "MPEG Video Compression Standard: 15.2 Encorder and Decorder Buffering," Chapman and Hall Digital Multimedia Standards Series, pp. 340-356, XP002115299, ISBN: 0-412-08771-5, Chapman and Hall, New York, 1996.

Whybray, M.W. et al., "Video Coding—Techniques, Standards and Applications," BT Technol J. vol. 14, No. 4, Oct. 4, 1997, pp. 86-100, XP000722036.

"Sharp Product Information: VTST-Series NTSC/PAL Electronic Television Tuners," RF Components Group, Sharp Microelectronics of the America, 1997.

Edwards, Larry M., "Satisfying Your Need for Net Speed," San Diego Metropolitan, Sep. 1999, <<www.sandiegometro.com/1999/sept/speed.html>>, retrieved on Jul. 19, 2001.

Oz, Ran et al., "Unified Headend Technical Management of Digital Services," BigBend Networks, Inc., 2002.

Muriel, Chris, "What is Digital Satellite Television?," What is Digital Television Rev. 3.0, Apr. 21, 1999, SatCure, Sandbach, England, <<http://www.netcentral.co.uk/satcure/digifaq.htm>>, access on Apr. 20, 2001.

"CONEXANT Products & Tech Info: Product Briefs: CX24108," 2000-2002 Conexant Systems, Inc. access on Apr. 20, 2001.

"CONEXANT Products & Tech Info: Product Briefs: CX22702," 2000-2002 Conexant Systems, Inc. access on Apr. 20, 2001.

"TDC: Components for Modems & Digital Infotainment: Direct Broadcast Satellite Chipset," 2001 Telecom Design Communications Ltd., U.K., <<http://www.tdc.co.uk/modmulti/settop/index.htm>>, access on Apr. 20, 2001.

"White Paper: Super G: Maximizing Wireless Performance," Mar. 2004, Atheros Communications, Inc.. pp. 1-20, Document No. 991-00006-001, Sunnyvale, California.

Kwok, Y.K. et al., "Efficient Multiple Access Control Using a Channel-Adaptive Protocol for a Wireless ATM-Based Multimedia Services Network," Mar. 29, 2000, Computer Communications 24(2001) 970-983, University of Hong Kong, Hong Kong, PRC.

Liang, Ying-Chang et al., "Joint Downlink Beamforming, Power Control, and Data Rate Allocation for DS-CDMA Mobile Radio with Multimedia Services," 2000 IEEE, pp. 1455-1457. Ceneter for Wireless Communication, Singapore.

Razavi, Behzad, "Challenges in Portable RF Transceiver Design," Sep. 1996, 1996 IEEE, pp. 12-25, Circuits & Devices.

Mannion, Patrick, "IceFyre Device Cools 802.11a Power Consumption," Sep. 24, 2001, Planet Analog. National Semiconductor, <<http://www.planetanalog.com/story/OEG20010924S0079>>, access on Nov. 5, 2001.

"ICE Fyre Semiconductor: IceFyre 5-GHz OFDM Modem Solution," Sep. 2001, pp. 1-6, ICEFYRE: Rethink Wireless, IceFyre Semiconductor, Inc.

Pozar, David M., "Theory and Design of Ferrimagnetic Components," 1990, pp. 529, Microwave Engineering, Addison-Wesley Publishing Company, Inc.

"Part 11: Wireless LAN Medium Access Control (MAC) and Physical Layer (PHY) Specifications: High-Speed Physical Layer in the 5 GHz Band," 1999 IEEE, pp. 1-83, Supplement to IEEE Standard fo rInformation Technology, IEEE Std 802.11a-1999, LAN/MAN Standards Committee.

Ciciora, Walter S., "Cable Television in the United States: An Overview," May 25, 1995, pp. 1-90, Cable Television Laboratories, Inc., Louisville, Colorado.

* cited by examiner

SYSTEM AND METHOD FOR PROCESSING AUDIO FRAMES

BACKGROUND

Widespread use of digital formats has increased the use of digital audio, such as Motion Picture Experts Group (MPEG) audio, in the multimedia and music industry alike. One method of compressing audio is performed by analyzing audio frames of an audio stream using a psycho-acoustical model to generate a signal-to-mask ratio table that is subsequently used by a compression algorithm to allocate data bits to various frequency bands. Typically, the psycho-acoustical model is implemented in a batch (non-real time) mode. However, with the steady increase in processing capability of data processors, instant real-time updating of the signal-to-mask ratio table has also been used, whereby each frame of the audio stream is analyzed and used to update the SMR table. However, real-time applications require costly high performance processing, such as the use of specialized digital signal processors, to process the audio stream in its entirety. Regardless of the ability to process audio in real-time to implement psycho-acoustical based compression, doing so is a computationally intensive process. Therefore, a system and or method of reducing the processing bandwidth, and hence the cost, used to implement psycho-acoustical audio compression in real-time would be useful.

FIELD OF THE DISCLOSURE

The present disclosure generally relates to data processing, and more specifically to the data processing of audio data.

BRIEF DESCRIPTION OF THE DRAWINGS

The present invention may be better understood, and its numerous features, and advantages made apparent to those skilled in the art by referencing the accompanying drawings.

The use of the same reference symbols in different drawings indicates similar or identical items.

DESCRIPTION OF THE DRAWINGS

In accordance with a specific implementation of the disclosure, a stream of audio frames is received and compressed using psycho-acoustical processing. A signal-to-mask ratio table generated by the psycho-acoustical algorithm is updated using only a portion of the received audio frames. By updating the signal-to-mask ratio table using only a portion of the received audio frames, it is possible to support a high quality compression and transmission of an audio stream with a reduced amount of processing bandwidth as compared to instant updating of the SMR table in real time, where each frame is used to update. Specific implementations of the present disclosure will be better understood with reference to FIGS. 1-6 herein.

Figure 1:
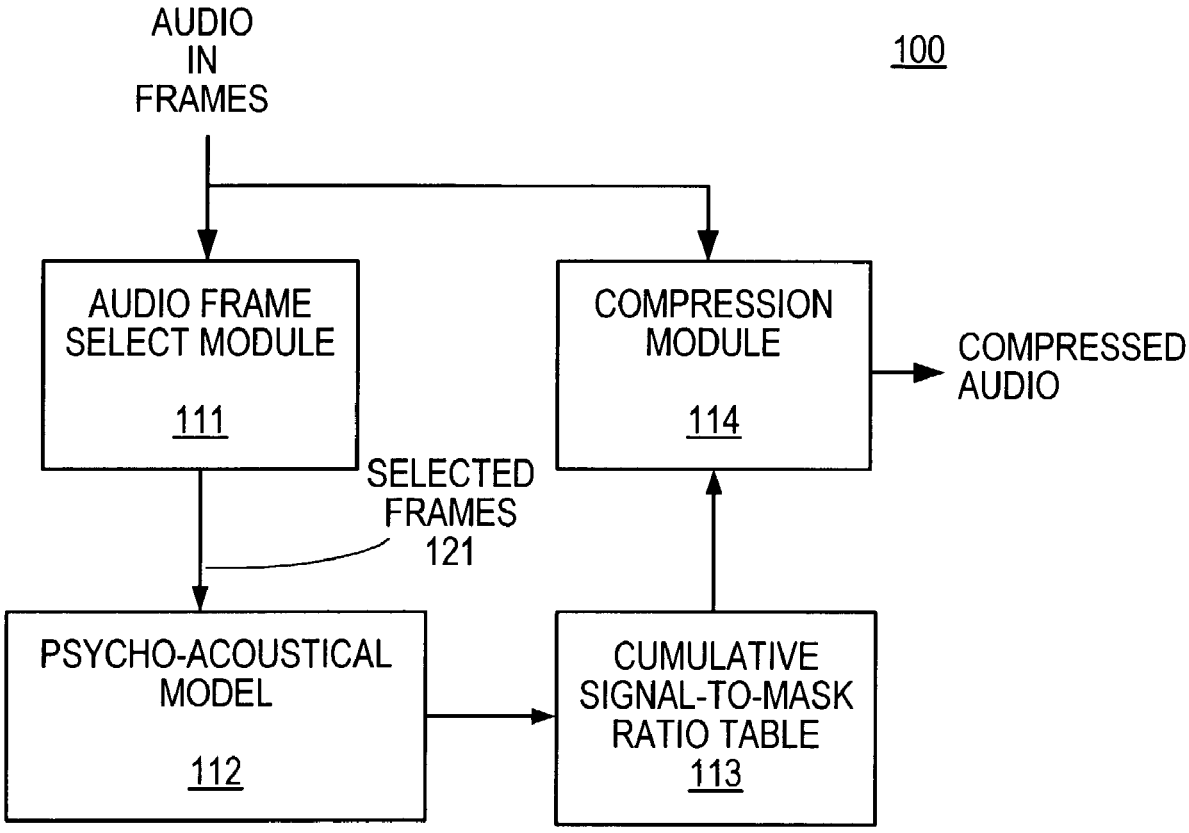
FIG. 1 illustrates in block diagram form a system in accordance with the present disclosure.

FIG. 1 illustrates, in block diagram form, a system 100 in accordance with the present invention. The system 100 comprises an audio frame select module 111, a psycho-acoustical model module 112, a cumulative signal-to-noise mask ratio table 113, and a compression module 114.

In operation, Audio In Frames are received at the audio frame select module 111. Typically, the Audio In Frames represent a high data rate audio signal, such as 48000 samples per second, 44100 samples per second or 32000 samples per second (16-bits per sample), while the compressed audio from module 114 is 128 or 224 kbps (kilobits per second). The audio frame select module 111 determines a portion of the Audio In Frames, identified as selected frames 221, to be processed by the psycho acoustical model. Selected frames 221 are received at the psycho-acoustical model 212, which uses the selected frames 221 to modify the cumulative signal-to-mask ratio table 213. The compression module 214 uses values stored in the signal-to-mask ratio table 213 to compress the Audio In Frames, thereby generating compressed audio.

In a specific embodiment, the audio frame select module 111 will identify every Nth audio frame as a selected frame. For example, every eighth Audio In Frame will be identified as a selected frame. Thus, for every eight audio frames received, one frame (a subset of 1 frame of the eight frames) would be identified as a selected frame and provided to the psycho-acoustical model 112.

The psycho-acoustical model 112 uses the received frames to modify the cumulative signal-to-mask ratio table 113. Modification of the signal-to-mask ratio table 113 is typically accomplished by converting the audio frame data to a frequency domain, using a fast fourier transform. Once converted to frequency data, local frequency bands represented in the cumulative signal-to-noise table 113 can be modified by the power value associated with the new audio frame. The values of the cumulative signal-to-mask ratio table 113 are cumulative because they are updated by current data. The cumulative signal-to-mask table is also statistical in that it is not updated by each audio frame.

Equation 1 represents a specific way of updating the cumulative signal-to-mask ratio table for each new audio frame in a statistical manner.

$$SMR[i]=(SMR[i]*(w-1)+SMRTMP[i])/w \qquad \text{Equation 1}$$

The variable "i" represents a specific frequency band of an audio signal. The number of frequency bands can vary, but is typically 32 for MPEG audio processing. SMR[i] represents the signal-to-mask ratio value of a specific frequency band, i, as stored in the cumulative signal-to-mask ratio table. The variable "w" is a weighting value. SMRTMP[i] represents a signal-to-mask ratio value component based on the currently selected frame.

The variable w is generally selected to be a value of between 1-0xFFFFFFFF, with typical ranges expected to be 0x5-0x10, 0xA-0x10, or 0xA-0x70. It will be appreciated that the smaller the weighting value, the more weight a new frame sample will have on the signal-to-mask table.

The compression module 114 receives the Audio In Frames and implements a SMR based compression algorithm based on the signal-to-mask ratio table 113. Examples of SMR based compression include MPEG1, layer-2, and layer-1 audio compression. Note in the embodiments illustrated that each of selected frames 121 is also provided to the compression module 114 for compression. A specific selected frame can be compressed before or after it has been used to modify the cumulative signal-to-mask ratio table depending upon the specific system configuration.

The system of FIG. 1 is advantageous over previous systems, in that it allows for efficient real-time compression of audio that produces high-quality compression, without using the high bandwidth typically associated with instant modification of the signal-to-mask table based on every frame. The methods of FIGS. 2 and 3 disclose additional information in accordance with the disclosure that can be implemented by the system of FIG. 1.

Figure 2:
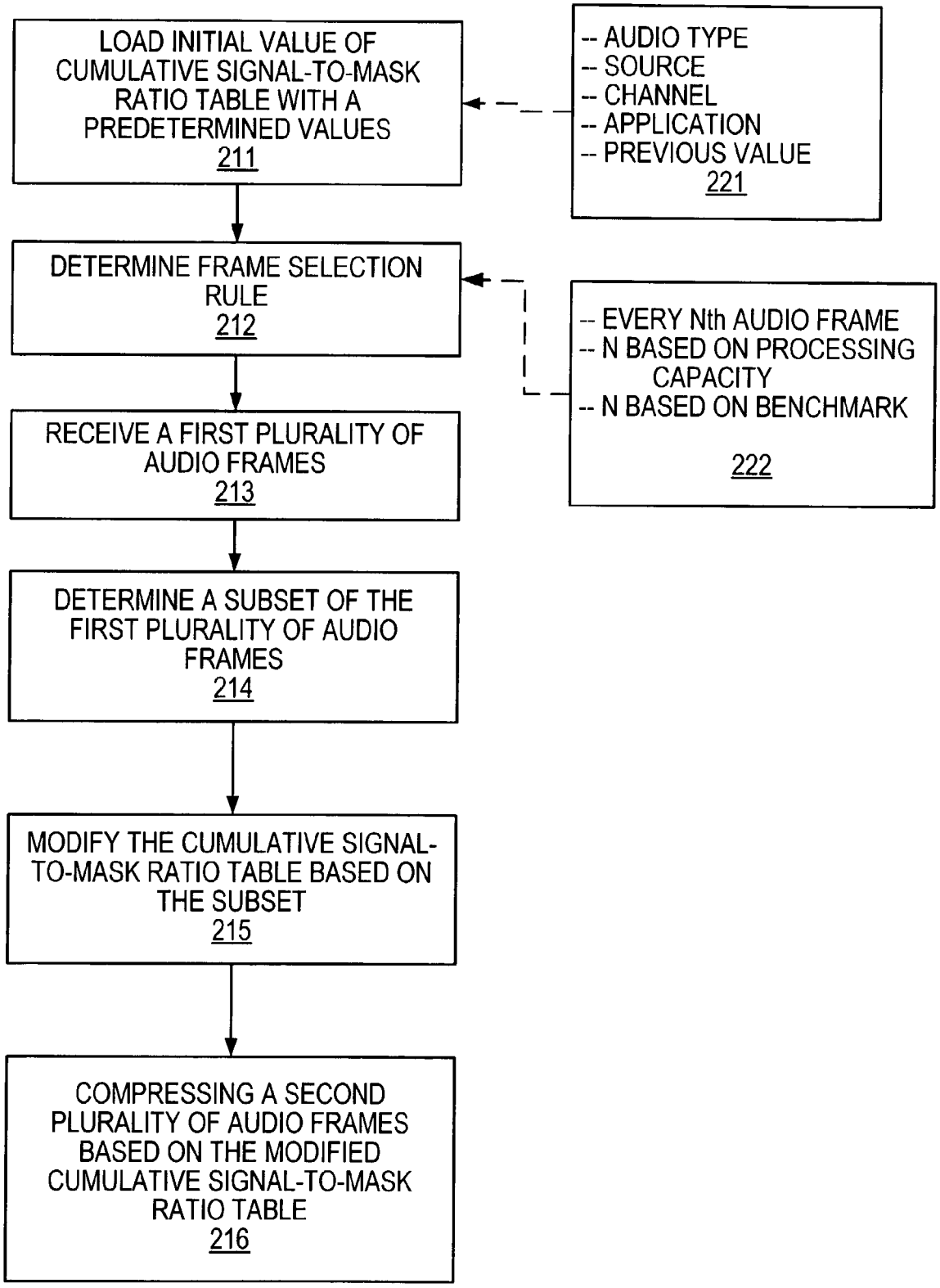
FIG. 2 illustrates in flow diagram form a method in accordance with the present disclosure.

FIG. 2 is a flow diagram of a method in accordance with the present disclosure. At step 211, an initial value for a cumulative signal-to-mask ratio table is loaded with predetermined values. Box 221 indicates various types of predetermined values that can be loaded. For example, the predetermined values can be based upon a type of audio to be compressed. Different types of audio data would include classical music, country music, rock music, jazz music, talk/speech, as well as many other types of audio. It will also be appreciated that a given type of music can have many different sub-types as well. For a specific type of audio, its initial signal-to-mask ratio value can be based upon a deterministic or empirical analysis of the specific type of audio. Another embodiment can save previous SMR table values generated through the use of the methods described herein.

Alternatively, the SMR table can be based upon a source of the audio. Examples of an audio source include radio, digital television, analog television, CD, DVD, VCR, cable, and the like. The loaded SMR value can be based solely on the source of the audio, or the SMR value can be based on a combination of variables. For example, the loaded SMR value for a common type of audio can be different depending on its source. This can be accomplished by storing separate tables, one for each possible combination, or by combining SMR values information from different tables to obtain a unique SMR table for each combination.

For a specific source, the SMR table used can vary by channel. Yet another embodiment would accommodate using a specific SMR table depending upon a specific application, or destination of the compressed audio.

At step 212, a frame selection rule for selecting a subset of the received frames is determined. In one embodiment, the frame selection rule indicates how often a frame is selected from the input frames to modify the SMR table. For example, the rule can state that one in N frames is selected, where the psychoanalytical model performs frequency conversion on these periodically selected frames. Alternatively, the rule can state that a certain number of sequential frames are selected for a given number of total frames. For example, X sequential frames are to be selected for every N*X received frames, whereby a frequency conversion would be performed on the X sequentially received frames. The value of N for these examples can be a fixed value, or deterministic based upon the processing capacity, or expected excess processing capacity of the system. For example, it may be determined that a system that is to perform the method of FIG. 2 as part of a larger application, uses 70% of its bandwidth implementing the application. Based upon this information, a value of N is selected to analyze a greater number of audio frames to bring the total system bandwidth to a desired level, such as 90%. For example, it may be determined that by setting N to eight will result in approximately a 90% utilization of system bandwidth. In another embodiment, a benchmark can be performed to determine the value N.

At step 213, a first plurality of audio frames is received. The audio frames can be received directly from a source, or can be frames that have been digitized by the system in response to receiving an analog signal from a source.

At step 214, a subset of the first plurality of audio frames is determined by applying the frame selection rule of step 212. For example, assuming a frame selection rule indicating that every eighth sample is to be selected, for a subset of eight audio frames, one frame will be selected.

At step 215, the cumulative SMR table is modified based upon the subset of selected frames. Typically, this occurs by analyzing the selected frame's power in each frequency band of the SMR table, and modifying the SMR table based upon this information.

At step 216, a second plurality of audio frames is modified based upon the SMR table modified at step 216. The second plurality of audio frames may or may not include the selected frame, depending upon a system's implementation.

Figure 3:
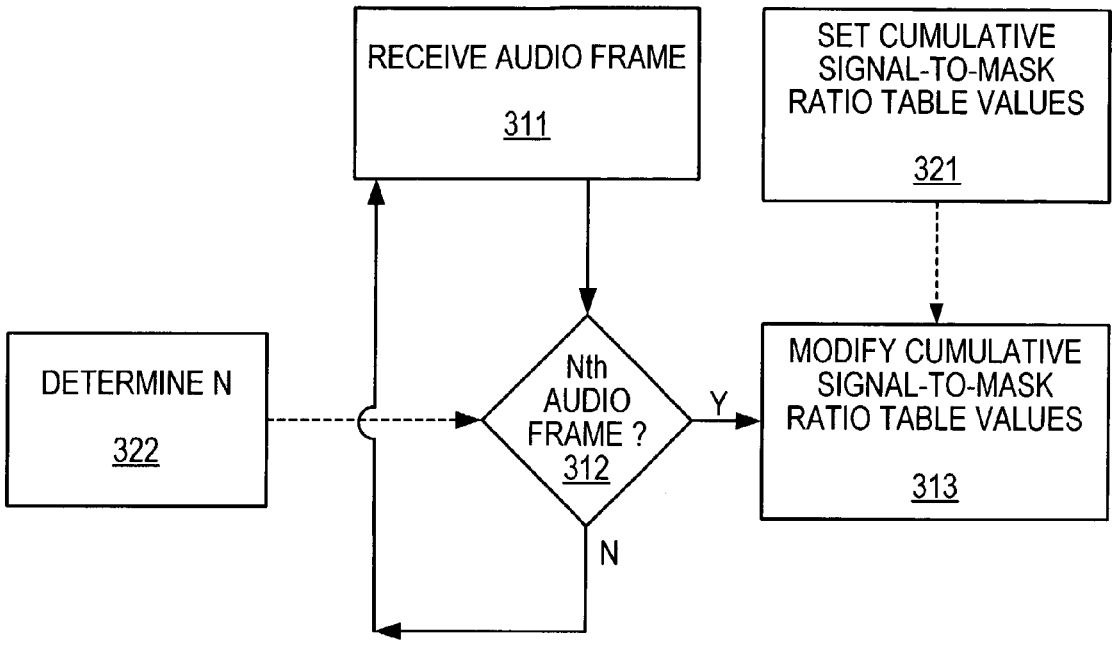
FIG. 3 illustrates in flow diagram form a method in accordance with the present disclosure.

FIG. 3 illustrates, in flow diagram form, a specific embodiment of the present disclosure. At step 321, a cumulative SMR table is set to a predefined value. Typically, this will occur prior to receiving any audio data, although the step 321 may occur at anytime, and may occur more than one time during operation. A dashed line between step 321 and step 313 indicates that the step 321 typically occurs before step 313, but does not necessary result in the execution of step 313. In a similar manner, a value of N is determined at step 322, and occurs before the step 312.

At step 311, an audio frame is received. At step 312, a determination is made whether the received audio frame is a selected frame meeting a frame selection rule. For example, is the current frame the Nth received audio frame since the last selected audio frame. If the frame is selected, the flow proceeds to step 313, where the cumulative SMR table is updated based upon the received audio frame before returning to step 311. If the received audio frame is not selected, the flow returns to step 311 from step 312, where a next frame is received, and the process repeats.

Figure 4:
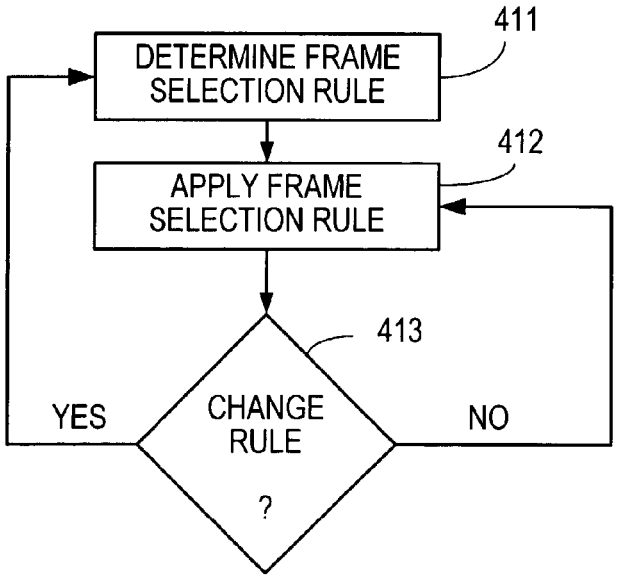
FIG. 4 illustrates in flow diagram form a method in accordance with the present disclosure.

FIG. 4 illustrates, in flow diagram form, a method that may be used with various other methods, such as the method of FIG. 3, to determine the frame selection rule to be applied. At step 411, a frame selection rule is determined. For example, a value N can be set to a predetermined value of eight, where N indicates how often, and/or how many audio frames are to be selected from an audio stream.

At step 412, the frame selection rule is applied to select one or more audio frames.

At step 413, a determination is made whether the rule should be changed. For example, the frame selection rule can change when the workload of a processing device goes outside of a specified range. For example, if the workload of a system processor drops below a lower value, say 90%, the number of audio frames to be processed by the psycho-acoustical model can be increased by reducing the value N. If the workload of a system process rises above an upper value, say 95%, the number of audio frames to be processed by the psycho-acoustical model can be decreased by increasing the value N.

Figure 5:
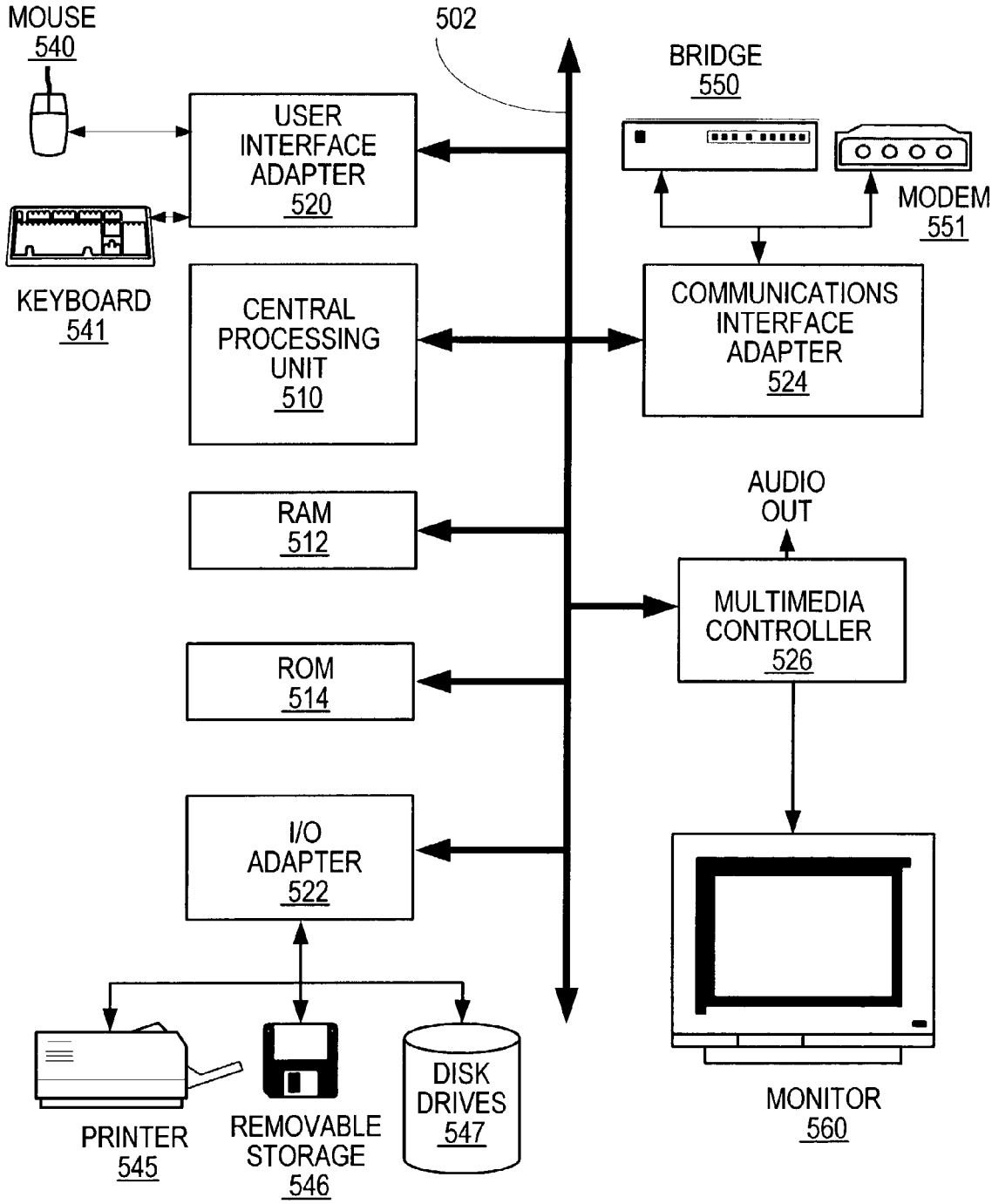
FIGS. 5 and 6 illustrates in block diagram form a system in accordance with the present disclosure.
Figure 6:
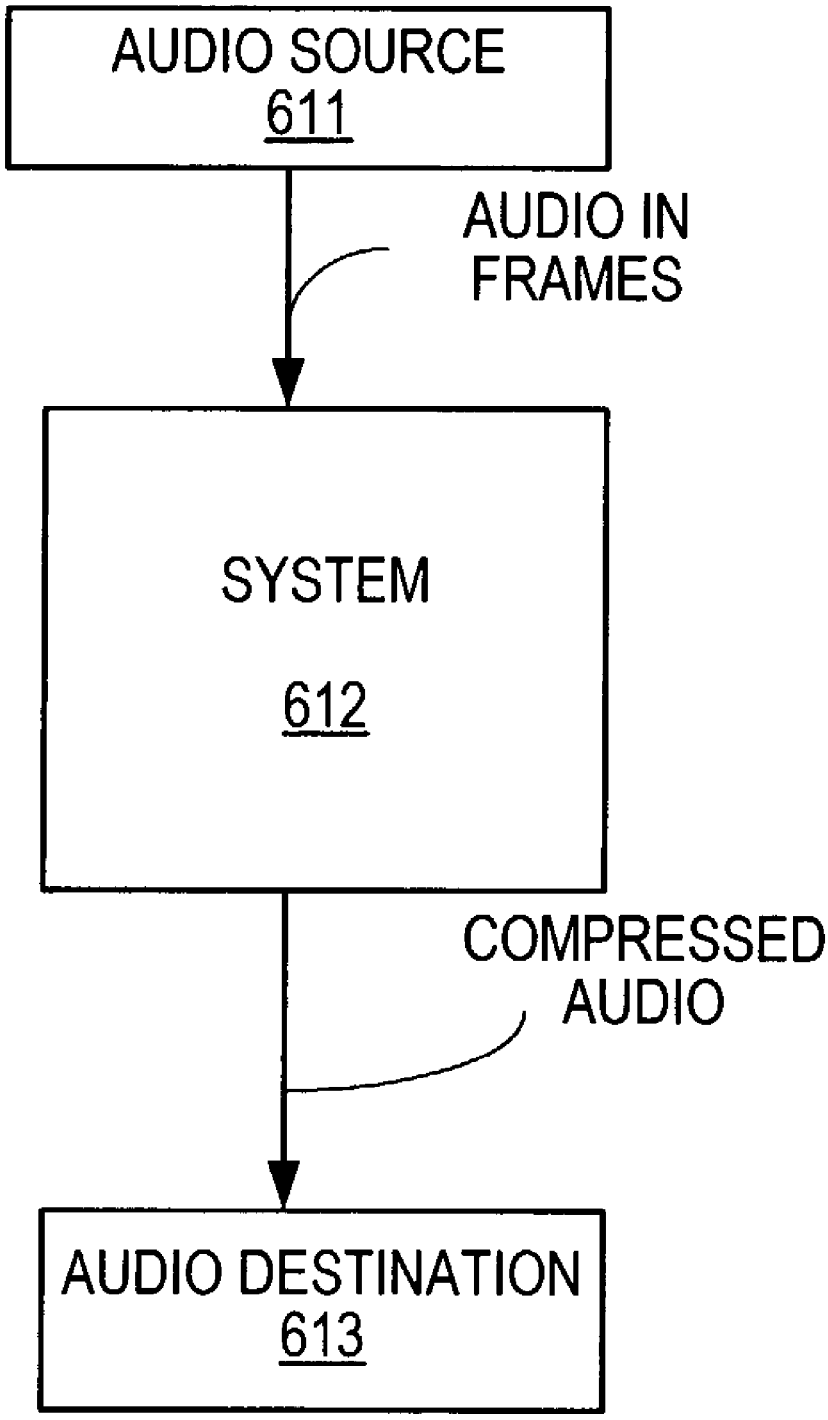

FIG. 5 illustrates, in block diagram form, a processing device in the form of a generic processing device that can represent a personal computer system or a specific system, such as system 612 of FIG. 6, that can implement the methods and/or systems described herein. The system of FIG. 5 is illustrated to include a central processing unit 510, which may be a conventional or proprietary data processor, memory including random access memory 512, read only memory 514, and input output adapter 522, a user interface adapter 520, a communications interface adapter 524, and a multimedia controller 526.

The input output (I/O) adapter 526 is further connected to, and controls, disk drives 547, printer 545, removable storage devices 546, as well as other standard and proprietary I/O devices as may be used in a particular implementation.

The user interface adapter 520 can be considered to be a specialized I/O adapter. The adapter 520 is illustrated to be connected to a mouse 540, and a keyboard 541. In addition, the user interface adapter 520 may be connected to other devices capable of providing various types of user control, such as touch screen devices.

The communications interface adapter 524 is connected to a bridge 550 such as is associated with a local or a wide area network, which may be wireless, and a modem 551. By connecting the system bus 502 to various communication devices, external access to information can be obtained.

The multimedia controller 526 will generally include a video graphics controller capable of displaying images upon the monitor 560, as well as providing audio to external components (not illustrated).

Generally, the system 500 will be capable of implementing at least portions of the system and methods described herein.

FIG. 6 illustrates a specific application comprising an audio source 611, system 612, and audio destination 613. In operation, the audio source provides audio data to the system 612. The audio data may be analog or digital audio. When the transmitted audio data is analog audio, it will be converted to digital audio frames by the system 612. The system 612 can be represented by the system of FIG. 5, where some or all of the components of FIG. 5 are implemented as part of the system 612. The system 612 implements an application that includes a cumulative SMR table that is periodically updated to compress the received audio data and to generate the compressed audio data. The compressed audio data is transmitted to an audio destination 613 for decompression and playback. In one embodiment, the compressed audio data is transmitted over a wireless connection to the audio destination 613.

In the preceding detailed description, reference has been made to the accompanying drawings that form a part hereof, and in which are shown by way of illustration specific embodiments in which the invention may be practiced. These embodiments and certain variants thereof, have been described in sufficient detail to enable those skilled in the art to practice the invention. It is to be understood that other suitable embodiments may be utilized and that logical, mechanical, chemical and electrical changes may be made without departing from the spirit or scope of the invention. In addition, it will be appreciated that the functional blocks shown in the figures could be further combined or divided in a number of manners without departing from the spirit or scope of the invention. For example, the selected audio frames to be processed by the psycho acoustical model are illustrated in FIG. 1 as being provided to the psycho-acoustical model 112 by the audio frame select module 211. It will be appreciated that while the audio frame select module 211 can provide a selected frame to the psycho-acoustical model 212, that in other implementations, the audio frame select module provides only an indication to the psycho-acoustical model to use a specific frame, as opposed to actually providing the frame itself. For example, a pointer or other indicator to use a specific or current frame can be provided to the psycho-acoustical model 112. In a similar manner, other connections disclosed herein may be accomplished in various manners. Also, it will be appreciated that for each selected frame, the cumulative SMR table can have some or all of its frequency bands updated depending upon the audio characteristics described. The preceding detailed description is, therefore, not intended to be limited to the specific forms set forth herein, but on the contrary, it is intended to cover such alternatives, modifications, and equivalents, as can be reasonably included within the spirit and scope of the appended claims.

What is claimed is:

1. A method comprising:

receiving a first plurality of audio frames;

determining a predetermined number of audio frames to achieve a predetermined workload level of a data processor;

selecting the predetermined number of audio frames from the first plurality of audio frames to generate a first subset of audio frames, the first subset of audio frames comprising fewer audio frames than the first plurality of audio frames;

modifying a first cumulative audio frame signal-to-mask ratio using the first subset of audio frames and a weighting value to generate a second cumulative audio frame signal-to-mask ratio;

receiving a second plurality of audio frames after modifying the first cumulative audio frame signal-to-mask ratio;

compressing the second plurality of audio frames based upon the second cumulative audio frame signal-to-mask ratio;

selecting a predetermined number of audio frames from the second plurality of audio frames to generate a second subset of audio frames, the second subset comprising fewer audio frames than the second plurality of audio frames;

modifying the second cumulative audio frame signal-to-mask ratio using the second subset of audio frames and the weighting value to generate a third cumulative audio frame signal-to-mask ratio;

receiving a third plurality of audio frames after receiving the second plurality of audio frames; and compressing the third plurality of audio frames based upon the third cumulative audio frame signal-to-mask ratio to generate a compressed audio data.

2. The method of claim 1, further comprising:

determining an audio frame bit allocation based upon the second cumulative audio frame signal-to-mask ratio.

3. The method of claim 1, further comprising:

setting the first cumulative audio frame signal-to-mask ratio to a predetermined value prior to receiving the first plurality of audio frames.

4. The method of claim 1, further comprising:

setting the first cumulative audio frame signal-to-mask ratio to a predetermined value, wherein the predetermined value is based upon a previously modified cumulative audio frame signal-to-mask ratio that has been stored.

5. The method of claim 1, further comprising:

setting the first cumulative audio frame signal-to-mask ratio to a predetermined value, wherein the predetermined value is selected based on an audio source.

6. The method of claim 1, wherein modifying the first cumulative audio frame signal-to-mask ratio using the first subset of audio frames and the weighting value to generate the second cumulative audio frame signal-to-mask ratio comprises:

determining a fourth audio frame signal-to-mask ratio using the first subset of audio frames; and determining the second audio frame signal-to-mask ratio based on a weighted averaging of the first cumulative audio frame signal-to-mask ratio and the fourth audio frame signal-to-mask ratio.

7. The method of claim 1, wherein the predetermined workload level comprises a predetermined workload range for the data processor.

8. A system comprising:

means for receiving a first plurality of audio frames;

means for determining a predetermined number of audio frames to achieve a predetermined workload level of a data processor;

means for selecting the predetermined number of audio frames from the first plurality of audio frames to generate a first subset of audio frames, the first subset of audio frames comprising fewer audio frames than the first plurality of audio frames;

means for modifying a first cumulative audio frame signal-to-mask ratio using the first subset of audio frames and a weighting value to generate a second cumulative audio frame signal-to-mask ratio;

means for receiving a second plurality of audio frames after modifying the first cumulative audio frame signal-to-mask ratio;

means for compressing the second plurality of audio frames based upon the second cumulative audio frame signal-to-mask ratio;

means for selecting a predetermined number of audio frames from the second plurality of audio frames to generate a second subset of audio frames, the second subset comprising fewer audio frames than the second plurality of audio frames;

means for modifying the second cumulative audio frame signal-to-mask ratio using the second subset of audio frames and the weighting value to generate a third cumulative audio frame signal-to-mask ratio;

means for receiving a third plurality of audio frames after receiving the second plurality of audio frames; and means for compressing the third plurality of audio frames based upon the third cumulative audio frame signal-to-mask ratio to generate a compressed audio data.

9. The system of claim 8, further comprising:

means for setting the first cumulative audio frame signal-to-mask ratio to a predetermined value prior to receiving the first plurality of audio frames.

10. The system of claim 8, further comprising:

means for setting the first cumulative audio frame signal-to-mask ratio to a predetermined value based on an audio source.

11. The system of claim 8, wherein:

the predetermined number of audio frames is based upon an available bandwidth of a data processor.

12. The system of claim 8, wherein the means for modifying the first cumulative audio frame signal-to-mask ratio using the first subset of audio frames and the weighting value to generate the second cumulative audio frame signal-to-mask ratio comprises:

means for determining a fourth audio frame signal-to-mask ratio using the first subset of audio frames; and means for determining the second audio frame signal-to-mask ratio based on a weighted averaging of the first cumulative audio frame signal-to-mask ratio and the fourth audio frame signal-to-mask ratio.

13. The system of claim 8, wherein the predetermined workload level comprises a predetermined workload range for the data processor.

14. A method comprising:

receiving a first plurality of audio frames;

determining a first predetermined number of audio frames to achieve a predetermined workload level of a data processor at a first time;

selecting the first predetermined number of audio frames of the first plurality of audio frames to determine a subset of the first plurality of audio frames;

determining a first signal-to-mask ratio based on the subset of the first plurality of audio frames;

receiving a second plurality of audio frames;

compressing the second plurality of audio frames based on the first signal-to-mask ratio to generate a first compressed audio data;

determining a second predetermined number of audio frames to achieve the predetermined workload level of a data processor at a second time;

selecting the second predetermined number of audio frames of the second plurality of audio frames to determine a subset of the second plurality of audio frames based on a second available bandwidth of a data processor at a second time;

determining a second signal-to-mask ratio based on the subset of the second plurality of audio frames;

determining a third signal-to-mask ratio based on the first signal-to-mask ratio and the second signal-to-mask ratio;

receiving a third plurality of audio frames; and compressing the third plurality of audio frames using the third signal-to-mask ratio to generate a second audio data.

15. The method of claim 14, wherein the predetermined workload level comprises a predetermined workload range for the data processor.

* * * * *